United States Patent [19]

Farmer

[11] Patent Number: 4,872,556

[45] Date of Patent: Oct. 10, 1989

[54] PACKAGING DEVICE WITH BURST-OPEN SEAL

[76] Inventor: Bert Farmer, 99 N. Main St., Farmington, Me. 04938

[21] Appl. No.: 115,352

[22] Filed: Nov. 2, 1987

[51] Int. Cl.[4] ..... B65D 47/36; B65D 83/00

[52] U.S. Cl. ..... 206/484; 206/632; 222/94; 222/107

[58] Field of Search ..... 206/219, 221, 484, 601, 206/604, 605, 609, 610, 634, 632; 222/92–94, 96, 97, 106, 107

[56] References Cited

U.S. PATENT DOCUMENTS

| | | | |
|---|---|---|---|
| 3,184,121 | 5/1965 | Volckening | 206/277 |
| 3,334,790 | 8/1967 | Eaton | 426/115 |
| 3,913,789 | 10/1975 | Miller | 206/484 |
| 4,093,067 | 6/1978 | Hollander, Jr. | 426/115 |
| 4,301,923 | 11/1981 | Vuorento | 206/484 |
| 4,537,308 | 8/1985 | Hollander, Jr. | 206/484 |
| 4,657,159 | 4/1987 | Grant | 222/107 |

*Primary Examiner*—Jimmy G. Foster
*Attorney, Agent, or Firm*—B. Craig Killough

[57] ABSTRACT

A package is disclosed herein which may contain a fluid material which is capable of being discharged from the package by the application of manual pressure from a thumb and a forefinger to the package so as to cause the package to burst in a controlled fashion to discharge the fluid material contained within the package. The package may comprise a second chamber which receives the fluid material discharged from the first chamber after the first chamber is burst by manual pressure so as to further control the rate and manner of discharge of the fluid material from the package.

6 Claims, 3 Drawing Sheets

PACKAGING DEVICE WITH BURST-OPEN SEAL

BACKGROUND AND SUMMARY OF THE INVENTION

This invention relates to packaging generally, and is more specifically related to a package which may contain single portion, dose or application of fluid material and which will discharge the fluid material from the package in a controlled fashion by the application of manual pressure to the package and the fluid material contained therein.

Various packages or containers are available in the prior art which contain a single portion, dose or application of liquid, semi-solid, colloidal or other fluid material. More particularly, the art to which this invention is directed is that which is characterized by two sheets of material, generally plastic or metal foil, which are sealed or seamed around the perimeter to form an envelope which contains the fluid material. Specific examples are single portion packages of condiments, such as ketchup and mustard, which are found in the food industry, and single application packages of lotions, such as hand lotion, or single doses of medicines which are contained in similar packaging.

To open these packages, the seal must be torn or ripped, which can be difficult to accomplish by manual means. Plastic packages, which are more common than foil packages due to cost, are difficult to grip, and the most difficult part of the package to tear is at the seam. While these packages are generally easy to cut with scissors or similar tools, such tools are not readily available in many situations, such as at restaurants where single portion packages of condiments are dispensed.

Accordingly, it has long been desired that single portion packages of this type be capable of opening by the application of manual pressure to the package and to the contents of the package. The difficulty in producing such a package has been the achievement of a seal or other means which will control the rate of discharge of the material from the package in a satisfactory manner, while not being subject to bursting in an undesired fashion. While the prior art has produced a seal which will burst under manual pressure, this seal may be too easily burst, resulting in the contents being discharged at an undesired time, such as during the shipping and handling of the package. Seals in the prior art which are more difficult to burst under manual pressure tend to cause the contents to be discharged with such force that the application of the contents cannot be properly controlled. Certainly, in the restaurant setting, having condiments discharged from the packaging in an uncontrolled fashion is not conducive to the sanitation of a restaurant. Likewise, where medicines are contained within such packages, if a portion of the contents is misdirected, proper dosage cannot be controlled.

The present invention provides a single portion, dose or application package from which the contents can be discharged in a controlled fashion by applying manual pressure, most commonly by the thumb and forefinger, to the package and its contents. The present invention comprises a chamber which is formed by two sheets of material sealed around the perimeter, with a portion of the perimeter seal produced so as to peel apart in a controlled fashion as the fluid material contents are forced against the seal by manual pressure, so as to release the contents in a relatively slow, controlled fashion. While a single chamber sealed in this fashion will produce a package, standing alone, which will satisfactorily dispense the contents thereof by the manual application of pressure, to further insure the controlled discharge of the fluid material from the package, a second chamber may be employed which is empty until the contents of the first chamber are discharged, with the second chamber receiving the contents of the first chamber upon discharge of the first chamber. This second chamber further has a seal which will burst under a smaller amount of manual pressure than the seal in the first chamber, so as to discharge the fluid material contents from the package in a controlled fashion.

DETAILED DESCRIPTION OF THE DRAWINGS

Figure 1:
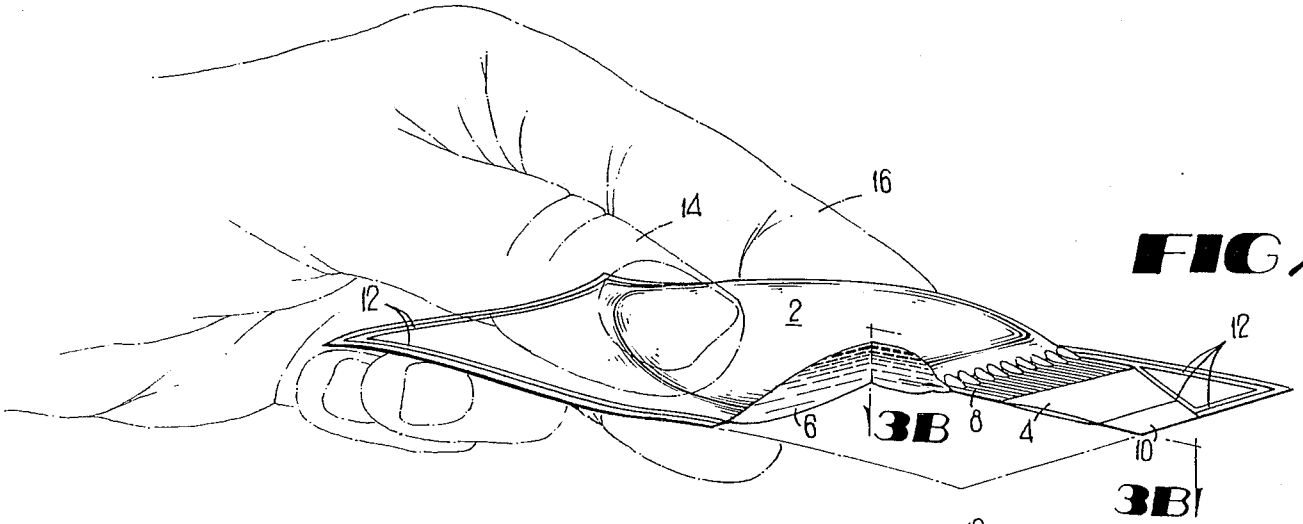
FIG. 1 is a perspective view of the package material with manual pressure being applied to the package and the fluid contents contained therein.

FIG. 1 is a perspective view of the package with manual pressure being applied to the first chamber 2 and the liquid material 6 contained in the first chamber 2. The seal 8 is shown as it begins to peel apart from pressure exerted on it as the fluid material 6 enters the seal 8 under manual pressure toward the second chamber 4 which is contiguous to the first chamber 2 and which is separated by the seal 8.

Figure 2:
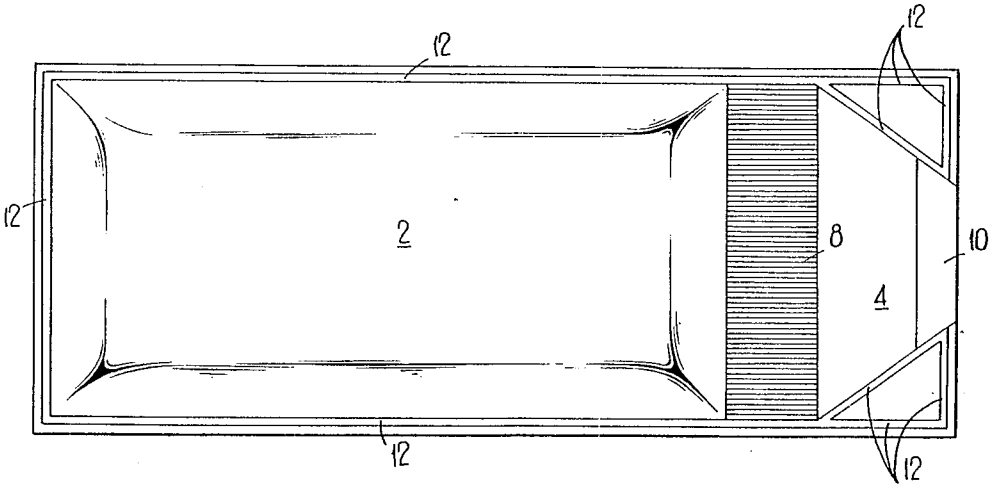
FIG. 2 is top, plan view of the package invention.

FIG. 2 depicts a top, plan view of the package, with the first chamber 2, seal 8, second chamber 4, and discharge seal 10. Also shown is the package seal 12 around the majority of the perimeter of the package, which is not capable of bursting under manual pressure.

Figure 3A:
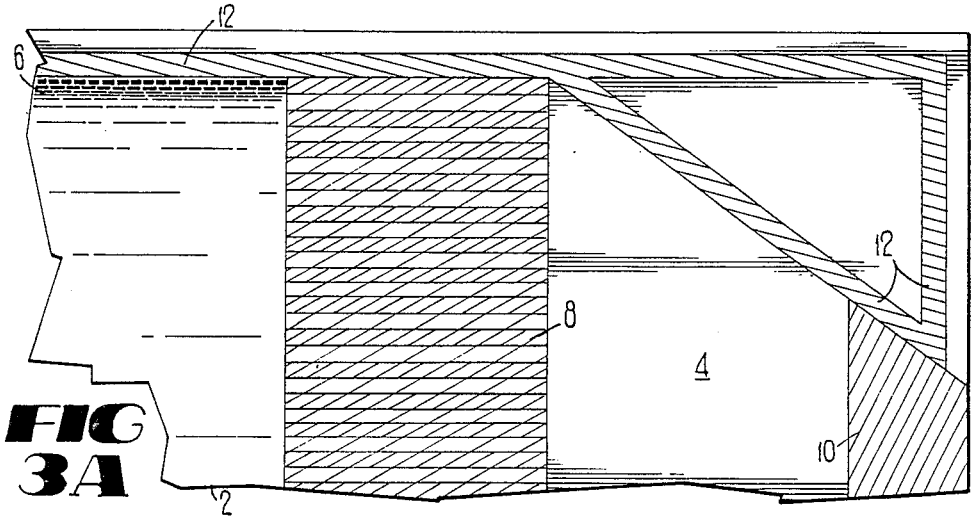
FIGS. 3A–3E are top, fragmentary views showing the progression of the fluid material through the package and the discharge of the material from the package.

FIG. 3A depicts a fragment of the package in a static position, viewed from the top, with the fluid material 6 located in the first chamber 2, and contained by the package seal 12, and seal. Contiguous to seal 8 in the first chamber is the second chamber 4, which is bordered by package seal 12 and discharge seal 10.

Figure 3B:
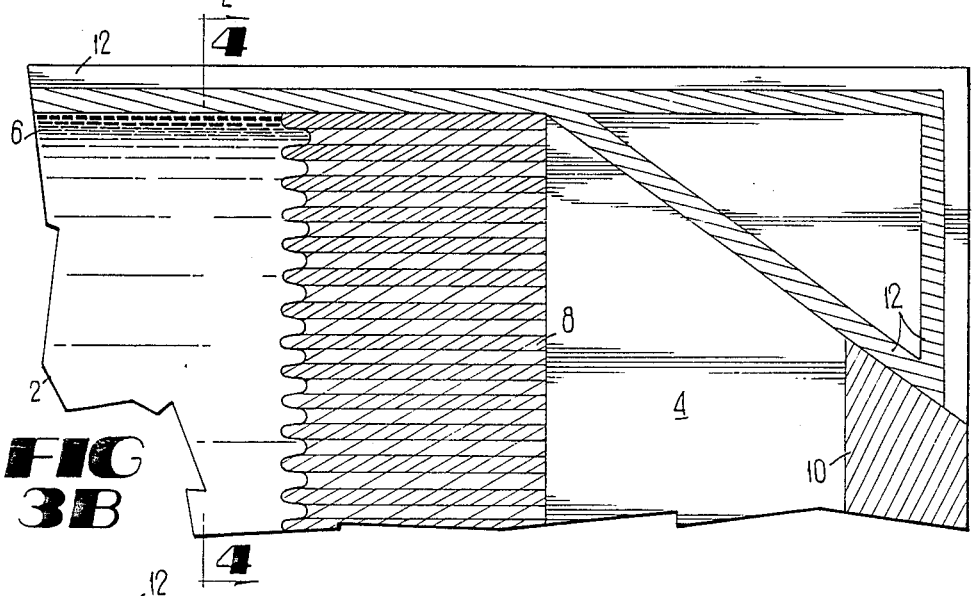

FIG. 3B is substantially identical to FIG. 3A, but depicts the package as it becomes dynamic due to pressure being applied to the first chamber 2 and fluid material contents 6, and shows seal 8 beginning to separate. FIG. 3B is derived substantially from Section 3B—3B of FIG. 1.

Figure 3C:
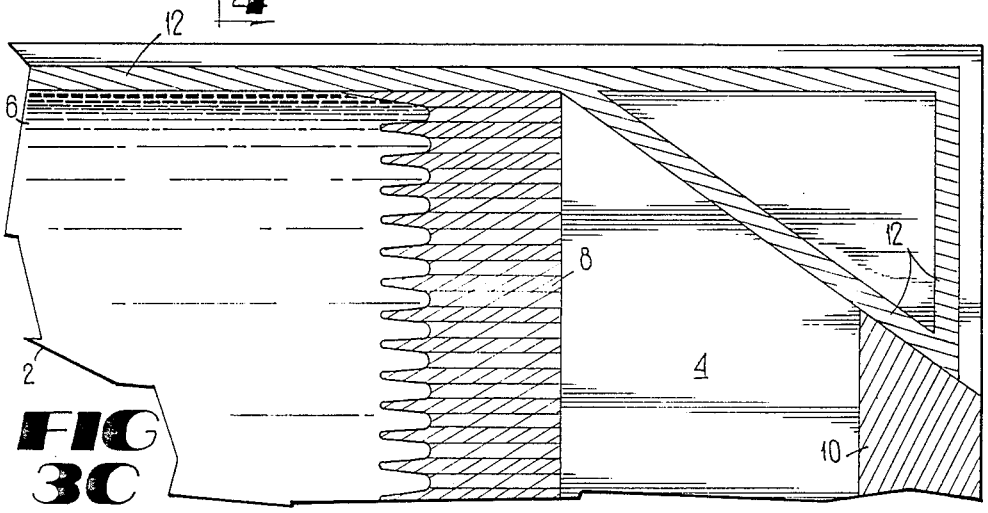

FIG. 3C continues the progression of the fluid material 6 as it exits the first chamber 2 through seal 8, and is substantially identical to FIG. 3B.

Figure 3D:
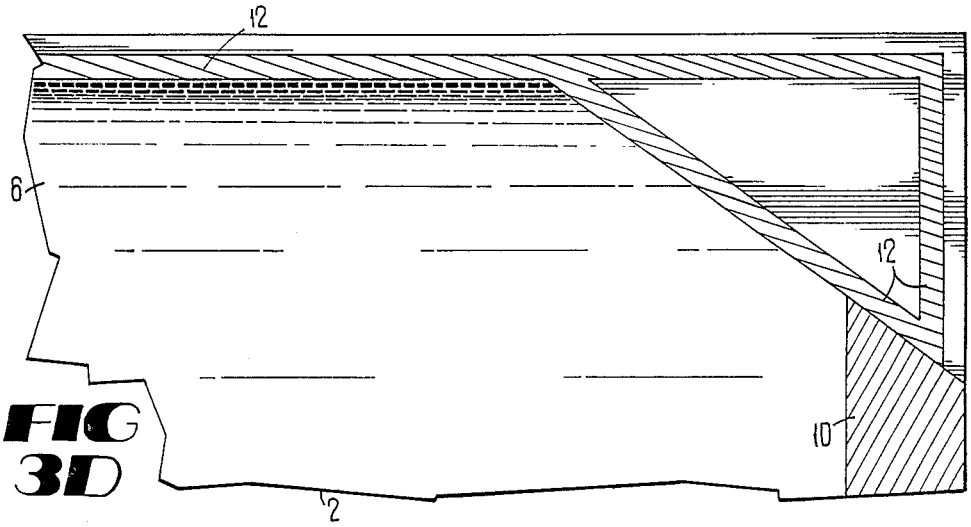

FIG. 3D depicts the package after the fluid material contents 6 of the first chamber 2 have penetrated seal 8 and entered into the second chamber 4, but before the contents have burst discharge seal 10.

Figure 3E:
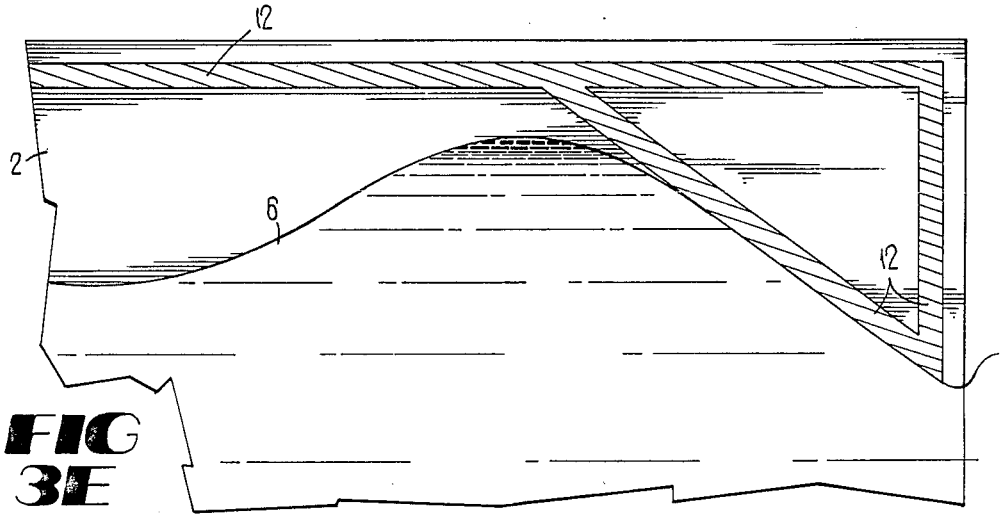

FIG. 3E depicts the fluid material 6 under pressure bursting discharge seal 10 so as to exit the package through discharge seal 10.

Figure 4:
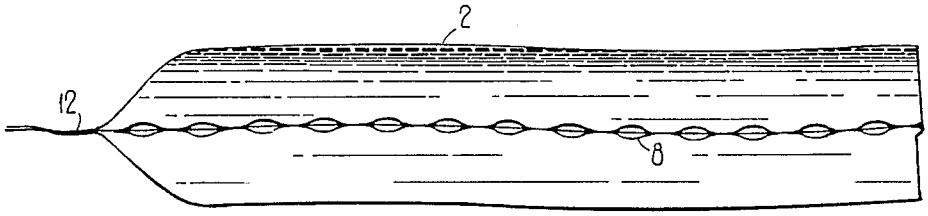
FIG. 4 is a partial, sectioned side elevation of the package showing the seal.

FIG. 4 emphasizes the seal 8 while also showing permanent seal 12 and first chamber 2 with the liquid contents contained therein.

DETAILED DESCRIPTION OF THE PREFERRED EMBODIMENT

The present invention is a package which contains a single portion, dose, or application of a liquid, semi-solid, colloidal, or fluid material, which, upon sufficient manual pressure being applied to the package, will discharge the contents of the package in a controlled manner for the desired application of the contents.

The package is characterized by two sheets of material, preferrably plastic, which are sealed around the perimeter of the package as will be more fully disclosed herein. A seal 8 is utilized which will separate, or peel apart, in a controlled fashion as pressure is exerted on the package and the contents of the package. The makeup of this seal 8, as will be seen herein, yields a package from which the contents can be discharged in a controlled fashion by applying manual squeezing pressure to the package and the contents.

In the preferred embodiment, as shown in FIG. 2, the package is constructed from two parallel sheets of material which are substantially identical to each other, having the same size and shape. The two sheets of material are attached to each other by sealing, and in the case of plastic, by sealing the two sheets by means of relatively high heat and pressure around a majority of the perimeter of the package, to produce a permanent package seal 12. This permanent seal 12 is not susceptible to breaking or bursting under manual pressure, and is similar to the type of seal used in sealing single portion packages presently in the art. By sealing the two sheets of material around the perimeter, a void remains within the package in which the fluid material contents are contained.

The present invention, in the embodiment shown in FIG. 2, utilizes a first chamber 2 and a second chamber 4. The first chamber 2 contains the fluid material 6 contents of the package. The second chamber 4 is contiguous to the first chamber 2, but is separated by seal 8.

When manual pressure is applied to the first chamber 2 portion of the package and the fluid material 6 contained therein, seal 8 separating the first and second chamber begins to separate, or peel apart. This seal is designed so that it begins to peel apart upon pressure being placed upon it by squeezing of the package manually, such as by the thumb 14 and forefinger 16 as shown in FIG. 1.

The pressure upon seal 8 causes seal 8 to begin to separate or peel apart as is shown in FIGS. 3B and 3C, with the fluid material 6 entering seal 8 and forcing it apart in a relatively slow fashion so as to control the discharge or exit of the fluid material 6 from the first chamber 2. As seal 8 is sufficiently separated, a portion of the fluid material 6 enters the second chamber 4. As the fluid material 6 enters the void of the second chamber 4, the rate and force of flow of the fluid material 6 is slowed due to the increased volume provided by the second chamber 4. As the second chamber 4 fills with the fluid material 6 and the pressure of the fluid material therein increases, the discharge seal breaks 10, allowing the material 6 to exit from the package in a controlled fashion so that the application of the contents of the package can be performed in a satisfactory manner.

In the preferred embodiment, seal 8 is produced in a corrugated fashion, and is relatively wide when viewed from the top (FIG. 2) in comparison to the remainder of the seals of the package. The width of seal 8 allows seal 8 to peel apart, rather than bursting apart, to control the rate of discharge of the fluid material from the first chamber. The corrugated feature of seal 8 aids in the peeling apart of seal 8, whereas a flat, or non-corrugated, seal would be more difficult to construct so as to achieve the "peeling" feature of the seal.

The seal 8 may be produced by applying a heated mandrel having teeth to form the corrugated pattern, or a similar device (which could even be the jaws of pliers or vise grips), which has been heated, and using it to apply pressure to the external surfaces of the two sheets of material. The width of the seal and the temperature of the mandrel which are required for the seal to burst at the proper pressure are determined by the contents of the package and the material from which the package is constructed. By way of example, for a package made of 3 mil vinyl stearate, containing ketchup, it has been found that by heating the mandrel in oil to a temperature of about 128 degrees Fahrenheit that a proper seal having a width of 5/16 inches is obtained. If 2 mil polyvinyl stearate is used, then the proper temperature should be about 118 degrees Fahrenheit. By comparison, the package seal 12 is produced at a much higher temperature. The relatively lower temperature used to create seal 8 results in a seal which will separate or peel in the desired fashion.

If seal 8 is properly constructed, it will discharge the fluid contents by application of manual pressure to the pressure to the package, without the package being overly susceptible to accidental or undesired discharge. However, to further insure undesired discharge, and to further control the discharge rate of the fluid contents of the package, a second chamber 4 and discharge seal 10 may be utilized. While the discharge rate of the fluid material 6 from the first chamber 2 through the seal 8 is much slower and more controlled than it would be under the application of the amount of pressure which it would take to discharge the material from packages found in the prior art, the discharge rate from the first chamber is further slowed due to the additional volume which the second chamber 4 provides for the fluid material as it exits from the first chamber 2. The discharge seal 10 which is utilized in the package is of smaller width and is produced at lower heat than seal 8 and ideally has a bursting pressure of somewhere around ½ p.s.i.

The present invention provides a package which may be used for single portion, application or dose packaging of various fluid materials ranging from food condiments such as ketchup to liquid medicines. The package may be opened by squeezing the contents within the package under manual pressure by the thumb and forefinger, while controlling the rate of discharge of the material from the package so that proper application and dispensation can be achieved. The package is superior to the prior art in that it is easier to open and requires no tools, and is designed so as to direct the contents of the package in a controlled fashion to the desired point of application.

What is claimed is:

1. A package for containing and discharging fluid materials, comprising two sheets of materials sealed together about a perimeter of said sheets so as to form a container in which a fluid material may be contained, wherein a portion of a seal so formed is not capable of bursting under manual pressure and the remaining portion of said seal is capable of bursting under manual pressure applied to said container, and wherein said seal which is capable of bursting under manual pressure is formed by applying pressure to said sheets by a heated, corrugated forming means.

2. A package for containing and discharging fluid materials, comprising:

(a) a first chamber which will burst under manual pressure applied to said first chamber and a fluid material contained within said first chamber so as to discharge said fluid material; and (b) a second chamber contiguous to said first chamber which will receive said fluid material as it is discharged from said first chamber and which will burst under lesser pressure applied to said second chamber, and said fluid so as to discharge said fluid from said package.

3. A package for containing and discharging fluid materials, comprising:

(a) a first chamber formed by two sheets of material sealed together about the perimeter of said first chamber, having a seal on one portion of said perimeter which will burst under manual pressure applied to said first chamber and to a fluid material contained within said first chamber so as to discharge said fluid material from said first chamber;

(b) a second chamber formed by two sheets of material sealed together about the perimeter of said second chamber, with said second chamber being contiguous to said first chamber so as to receive said fluid material as it is discharged from said first chamber, and having a seal on one portion of said perimeter of said second chamber which will burst under less pressure than said seal of said first chamber so as to cause said fluid to be discharged from said package.

4. A package for containing and discharging fluid materials as described in claim 3, wherein said seal on one portion of said perimeter of said first chamber which will burst under manual pressure is formed by applying a heated, corrugated forming means to said sheets under pressure, so as to form a seal which will peel apart in a controlled fashion as said fluid material under pressure enters said seal.

5. A package for containing and discharging fluid materials, comprising:

(a) a first chamber having a seal on one portion of said perimeter which will burst under manual pressure applied to said first chamber and to a fluid material contained within said first chamber so as to discharge said fluid material from said first chamber;

(b) a second chamber which is contiguous to said first chamber so as to receive said fluid material as it is discharged from said first chamber, and having a seal on one portion of a perimeter of said second chamber which will burst under less pressure than said seal of said first chamber so as to cause said fluid material to be discharged from said package.

6. A package for containing and discharging fluid materials as described in claim 5, wherein said seal on one portion of said perimeter of said first chamber which will burst under manual pressure is formed by applying a heated, corrugated forming means to said sheets under pressure, so as to form a seal which will peel apart in a controlled fashion as said fluid material under pressure enters said seal.

* * * * *